United States Patent [19]

Niske

[11] Patent Number: 4,746,058

[45] Date of Patent: May 24, 1988

[54] MATERIAL FOR PACKING CONTAINERS

[75] Inventor: Jörgen Niske, Lund, Sweden

[73] Assignee: Tetra Pak International AB, Lund, Sweden

[21] Appl. No.: 821,339

[22] Filed: Jan. 22, 1986

[30] Foreign Application Priority Data

Jan. 25, 1985 [SE] Sweden ..... 8500350

[51] Int. Cl.[4] ..... B65D 3/00

[52] U.S. Cl. ..... 229/3.5 MF; 229/132

[58] Field of Search ..... 229/3.5 MF, 17 R, 17 G, 229/132, 137, 48 SA, 48 SC, 48 T, 3.5 R, 3.1

[56] References Cited

U.S. PATENT DOCUMENTS

| | | | |
|---|---|---|---|
| 1,665,576 | 4/1928 | Witham | 383/906 |
| 3,010,260 | 11/1961 | Subklew . | |
| 3,179,025 | 4/1965 | Schur . | |
| 3,402,875 | 9/1968 | Palmer | 229/3.5 MF |
| 3,408,776 | 11/1968 | Kalwaites . | |
| 3,462,065 | 8/1969 | Asman | 229/132 |
| 3,779,786 | 12/1973 | Tone . | |
| 3,780,626 | 12/1973 | Hollier, Jr. . | |
| 3,854,249 | 12/1974 | Fletcher | 51/75 |
| 4,322,003 | 3/1982 | Long | 229/3.5 R |
| 4,533,576 | 8/1985 | Tanahashi et al. | 229/3.5 MF |

FOREIGN PATENT DOCUMENTS

| | | |
|---|---|---|
| 177615 | 12/1961 | Sweden . |
| 178425 | 3/1962 | Sweden . |
| 190896 | 8/1964 | Sweden . |
| 227734 | 3/1971 | Sweden . |

*Primary Examiner*—Willis Little

*Attorney, Agent, or Firm*—Burns, Doane, Swecker & Mathis

[57] ABSTRACT

A blank for packing containers having a carrier layer of paper or cardboard and a layer of thermoplastic-coated aluminum foil which is used for generating by means of induction devices the heat required for sealing overlapping plastic layers of the blank in a Z-shaped configuration wherein the aluminum foil layer is removed locally along the sealing regions in outer layers but is kept intact in the inner layer.

7 Claims, 1 Drawing Sheet

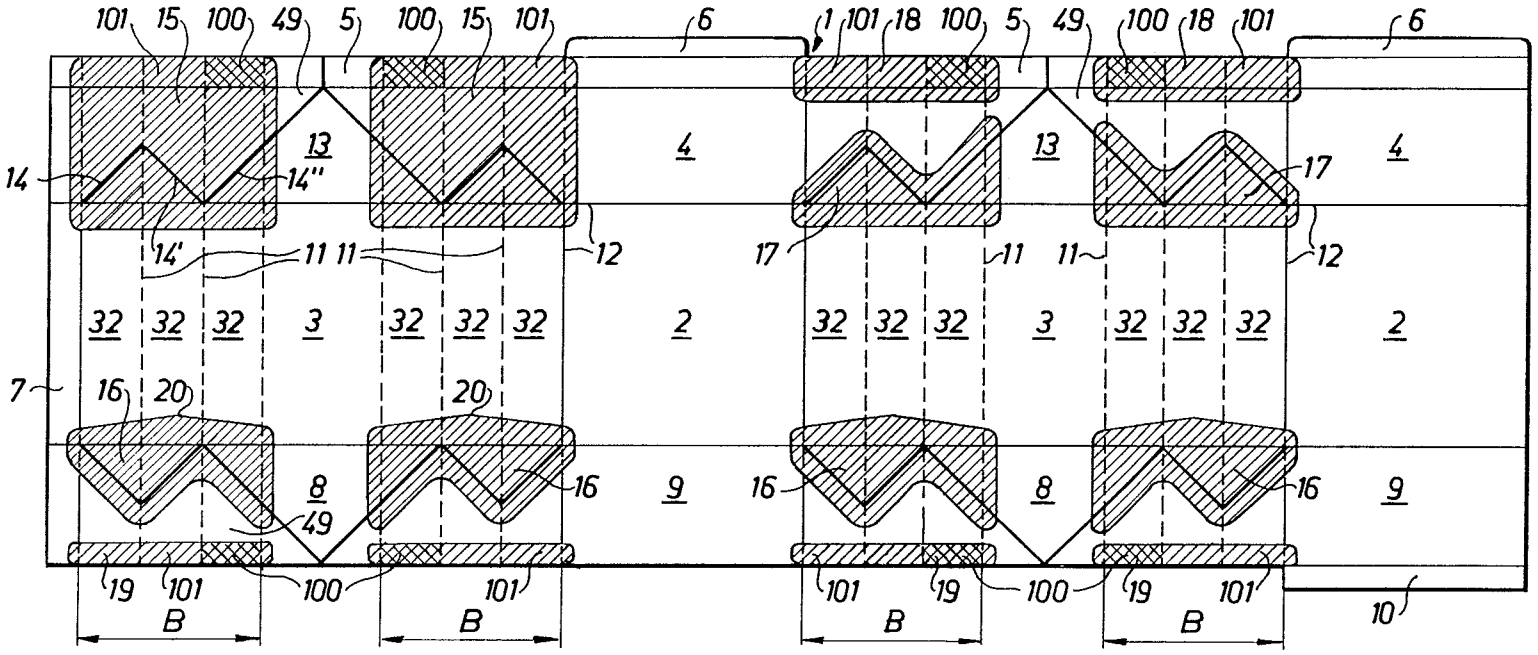
6
4
2
9
10
101
18
100
49
5
1
15
17
12
16
32
11
3
13
8
19
B
14
14'
14''
20
7

MATERIAL FOR PACKING CONTAINERS

BACKGROUND OF THE INVENTION

The present invention relates to a material for packing containers, this material comprising a carrier layer of cardboard or paper hereinafter also generally referred to as "paper material", inner and outer layers of thermoplastics and a layer of aluminum foil, selected portions of the material being intended through overlap-folding (so-called z-folding) and sealing together of the overlapping portions to produce reinforced regions or panels comprising three material layers sealed together. The invention also relates to the method for manufacturing the material.

In packaging technique packages of the non-returnable type have been used for a long time which are manufactured from a material which consists of a carrier layer of cardboard or paper and outer and inner coatings of thermoplastics. Frequently the packing material in such packages is also provided with layer of other materials, e.g. aluminum foil which is a gas-tight material and which makes possible sealing with the help of a high-frequency electromagnetic filed. In this method of sealing it is the objective to generate in the aluminum foil layer electric induction currents which heat the aluminum foil layer and through conduction transmit heat to the adjacent thermoplastic layer which constitutes the sealing layer of the material. The thermal energy required for the sealing operation is thus achieved in two stages, a first stage in which the aluminum foil layer is locally heated with the help of induction currents and a second stage where the heat of the aluminum foil layer is transmitted by thermal conduction to the thermoplastic sealing layer.

The composition of a packing material has the purpose of creating the optimum product protection for the goods which are to be packed, at the same time as imparting to the package sufficient mechanical protection for the product and adapting it so that it can be readily handled by the user of the package. To achieve mechanical rigidity which on the one hand provides mechanical protection and on the other hand makes it possible for the package to be of such rigid form that it can be handled and gripped by hand without difficulty, the packages of this type are often provided with a carrier layer of paper or cardboard. Such a carrier layer, however, has poor tightness characteristics in respect of gases or liquids and the good rigidity of the material disappears if the material is subjected to moisture which is absorbed into the material. To impart a good liquid-tightness to the material it is often laminated with a plastic material and if this plastic material is thermoplastic the plastic layers can be used in the manner mentioned previously to seal the plastic layers to each other with the help of heat and pressure, and in this manner the packing container can be sealed and made permanent in its given form by sealing the overlapping or adjacent material panels which are thermoplastic-coated to each other in a tight and durable seal.

Packing containers of the type referred to here are manufactured either from blanks punched out beforehand or from a continuous web which has been provided with suitable decoration and with a crease line pattern facilitating the fold-forming. The packing containers are manufactured from such a web by joining together the longitudinal edges of the web in an overlap joint so as to form a tube which is subsequently filled with the intended contents and divided into closed container units by means of repeated transverse seals of the tube perpendicularly to the longitudinal axis of the tube. After suitable fold-forming of the packing material in the tube the material in the said container units is converted to the desired geometrical shape, usually a parallelepiped, by providing the tube with longitudinal folding lines and with double-walled triangular lugs at the corners of the packing container. Whether packing containers are manufactured from blanks produced beforehand or from a continuous web, the material, for practical reasons, will be of uniform thickness. This means that the material, and in particular the carrier layer of paper or cardboard, is mechanically overstrong or overdimensioned along certain regions which during normal use and handling are not subjected to major mechanical stresses while other parts of the material in the package ought to be thicker or more rigid in order to withstand the mechanical strains which they are subjected to. In other words it would be desirable for the material to be of a differential thickness so as to achieve a better economic utilization of the material.

It is known that such a material with differential thickness can be produced by folding the material to form a double fold (a so-called z-folding), the overlapping portions of the material subsequently being sealed together to a rigid wall part of threefold material thickness. It is also known from Swedish patent application No. 8405539-1 that certain portions of such packing material can be thickness-reduced to make possible the folding and sealing of the material.

In the case where the sealing is realized with the help of a high-frequency electromagnetic field which induces currents within a selected sealing region such a sealing cannot be carried out on a z-folded material since this material in the region of the z-fold will have three material layers arranged on top of one another which, even if they are thickness-reduced, will each have an aluminum foil layer. This means that the outer coils generating the magnetic field which are used for creating the desired induction currents in the aluminum foil will generate an induction current in the aluminum foil layer situated closest that is to say the outer one while no current, or only negligible current, will be generated in the two subjacent aluminum layers, the innermost of which is that which is in direct contact with the thermoplastic layer which ought to be heated to sealing temperature. Hence it is not feasible in a sealing region to arranged several parallel aluminum foil layers situated on top of each other but the aluminum material in the two upper material layers in the z-region must be removed within the sealing region, since otherwise no sealing heat will be transmitted to the sealing region.

OBJECTS AND SUMMARY OF THE INVENTION

It is an objective to utilize the material in a package in the best possible manner and this is perhaps particularly desirable in the manufacture of those mass-produced non-returnable packages which are used for the packaging of milk and fruit juices. Owing to the high degree of mechanization and rapid rate of production in the manufacture of this type of packages, the material cost represents a very important part of the total cost of the package, so that large profits can be made by saving material, e.g. through rendering the utilization of the material more effective. One such more effective utilization of the material can be achieved if the quantity of material used is selected so that more material is used in the parts of the package which are to be strong or rigid while smaller quantities of material, that is to say thinner material, is used along the parts of the package which do not require greater rigidity or strength. This means that the material should have a differential thickness which e.g. can be achieved in that separate reinforcement panels are glued onto the material blanks. Such a process however, which is known, is cumbersome to realize and so expensive, moreover, that the profit which is gained through a more effective utilization of the properties of the material is spent by the extra costs of manufacturing the material.

Another method of solving the problem of differential thickness of a package aims at folding the material in an overlap fold to form a so-called z-fold wherein three material layers will overlap one another. A part of the wall in a package with such a z-folded portion will have a substantially greater rigidity than surrounding portions of the package wall but the disadvantage is that the material within the folding region will also have treble thickness which presents great problems in realizing liquid-tight seals of the packing material. The problem is that leakage channels arise in the said sealing joints at the transition between thinner and thicker material parts and as a result it has not been possible to apply the so-called z-fold in liquid packages to any great extent. Another problem in connection with z-folds is that folding of the material can be carried out only with great difficulty in those portions of the material which have been thickened through z-folding.

In accordance with this invention, a Z-fold is formed in the material in order to attain the desirable advantages from a point of view of strength but the material is made selectively thinner through active machining, preferably grinding or milling, along those portions of the material where folds are to be carried out or where sealing joints are to be located.

DESCRIPTION OF THE DRAWING

A preferred embodiment of the invention is illustrated in the accompanying drawing which is a top plan view of the inside face of a blank of a packing container.

DETAILED DESCRIPTION

As mentioned earlier it is possible when sealing combined layers of packing material which contain aluminum foil to obtain a good and rapid seal by making use of the good electric conducting characteristics of the aluminum material. By subjecting the part of the packing material which is to be sealed to a strong, high-frequency electromagnetic field induction currents can be generated rapidly and effectively in the intended areas of the aluminum foil layer, these induction currents in turn generating heat which by means of conduction is transmitted to adjacent sealing layers of thermoplastics which are rapidly made to melt and in so doing are fused together with another, similar, adjacent plastic layer so that a tight and durable joint is obtained. This type of sealing is used most frequently in automatic packing machines but, as mentioned earlier, it was necessary in the case described here, where the material is folded together in such a manner that three layers of material come to be situated on top of one another, to remove the aluminum layer within the sealing region of two of the sealing layers, since otherwise no heat would be generated in the inner aluminum foil layer while all the heat would be produced in the outer layer which does not impart any sealing heat to the thermoplastic sealing layer. However, if the aluminum foil layer in the sealing region can be removed on two of the three z-folded material panels 32 a high-frequency/induction sealing process can be carried out in the normal manner and with the good result known. Hence in the figure, which shows the inside of a packing blank, the double-hatched or checkered surfaces marked 100 are freed from aluminum foil layers whereas the aluminum foil layers remain on the areas 101 of the z-folded region B. For the best FIG. 1 shows an original blank for a packing container. This blank has been punched out of a sheet or a web of cardboard material of constant thickness and the blank is designated generally by numeral 1 in the figure. The blank 1 is divided by means of a pattern of crease lines 12 into sidewall panels 2 and 3, top closure panels 4 and 13 and bottom sealing panels 8 and 9. The top sealing panels 13 and bottom sealing panels 8 are triangular and are arranged so that they are folded in bellowslike manner in between the top closure panels 4 and bottom sealing panels 9 respectively. On folding in of the triangular panels 13 and 8 the adjoining panels 49 are folded back in such a manner that they come to be situated between the panels 4 and 13 and sections 9 and 8 respectively. This top and bottom design is found generally on a number of so-called "gable top" packages.

The blank 1 is formed in principle to a package by forming it to a tube of square or rectangular cross-section and by joining the short sides of the blank 1 to each other in that the longitudinal joint panel 7 is combined in an overlap joint with the opposite short side of the blank 1. After the blank has been formed to a tube of square or rectangular cross-section it is threaded onto a mandrel in a packing machine not shown here. While the tubular blank is on the mandrel the bottom wall panels 8 and 9 are folded in over each other in the manner indicated above, whereupon the bottom panels are sealed to each other by causing the thermoplastic coatings of portions situated against each other to fuse together through supply of heat and pressure. In order to stabilize the bottom seal one of the bottom wall panels 9 has been provided with a sealing lug 10 which during the bottom sealing will overlap the outer edge of the other bottom wall panel 9.

When the bottom seal has been executed the container formed is drawn off the mandrel and filled with the intended contents whereupon the top is closed by dropping the top closure panels 13 and 4 in over the opening of the container, the triangular panels 13 being located in between the outer rectangular panels 4.

In the realization of this folding in of the top panels the sealing panels 5 will be collected side by side in a sealing fin comprising four material layers. By pressing together these sealing panels while supplying heat the thermoplastic coatings provided on the surfaces of the panels are caused to melt and are joined to each other so as to form a liquid-tight and durable sealing joint. The top sealing panels 6 which adjoin the rectangular panels 4 will also be joined to each other in a sealing joint which will be situated above the sealing joint 5.

The blank 1 shown in the figure cannot be formed directly to a package, though, in the manner described above. In the case assumed here greater gripping rigidity of the package is desired which, in principle, means that one or both of the "gripping sides" of the package (that is to say the sides over which a gripping by hand is exercized during the handling of the package which normally will be the sidewalls 3 which adjoin the triangular top closure panels 13) is provided with stiffening beams in the form of z-folded sealed portions.

It is possible in other cases and for other purposes to arranged the reinforcing z-folded portions on different parts of the package, but in the embodiment assumed here it is the objective to arrange the stiffening portions or beams in such a manner that opposed sides are to be reinforced. To achieve this, the packing blank 1 is realized and treated in the following manner:

The parts of the blank 1 which are to be folded together in a z-pattern so that three material layers are formed along the z-folded portions have to be dimensioned so that they are of a width B which is three times greater than the width of the z-folded portion in the finished package blank. In FIG. 1 these portions which are to be z-folded are marked B and the wall panels which are to be folded together and joined to one another through heat-sealing are designated 32. For the realization of the z-fold folding lines, so-called crease line 11 have to be prepared in the material and these folding lines 11 are carried out either in the manner that the material is "crushed" or permanently deformed through linear indentations or else the crease lines can be realized in such a manner that material is removed through grinding or milling.

In order to allow the z-folded material to be sealed with the help of so-called induction heat it is necessary, in the manner described earlier, to remove the aluminum foil layer along the portions 100 within the z-folded regions 32 whereas the aluminum foil layer must be left intact along the portion 101 of the part of the z-folded region which will be situated nearest the sealing surface.

The method for removing the aluminum foil layer within the region 100 may vary but one method which has been found to be effective is grinding. Another method consists in punching cutouts into the aluminum foil web, preferably just before the aluminum foil web is laminated to the carrier layer of the packing material. It will be necessary, however, for the punched out portions to be accurately located, since they have to be matched accurately to the sealing regions. A simpler manner of approach would be to provide the carrier web in advance with at least parts of a crease line pattern 12,11 and in connection with the lamination sense this crease line pattern and guide the punch in such a manner that the punched out portions will match accurately the position of the crease line pattern both laterally and longitudinally, since it is of great importance that the punched out portions will be located in just those areas where doubled aluminum foil layers must not be present.

The present invention can be applied advantageously to the manufacture of the material which has been described in the Swedish patent application No. 8405539-1 wherein is described how the carrier layer of the material is thickness-reduced within the z-folded regions 15,16,17,18,19 which are intended to be included in the folding pattern or sealing regions of the packing containers. In the case shown here the areas reduced in thickness by grinding are marked by hatching. In this case the thickness-reducing machining ought to be done from the outside of the material while the removal of the aluminum foil ought to be done by means of machining in the direction of the inside of the material to which the thermoplastic sealing layer has been applied. After the machining which brings about the removal o the aluminum foil layer within the selected areas 100 and, of course, also after the lamination of the aluminum layer provided with punched out portions, the inside of the package has to be covered with a thermoplastic sealing layer which covers the aluminum foil and the said removed or punched-out portions 100. In the case where the packing material is not constituted of divided blanks but instead of a web which is unrolled from a roll the same process is applied in principle as described above in the case where the packing material is provided with an aluminum foil layer which is located close to the thermoplastic sealing layer of the material which is intended to form the inside of the package formed.

In practice both types of the packing material mentioned here are actually manufactured as a web which is successively laminated with a number of lamination layers of different kinds. The carrier layer which is the thickest layer is constituted as a rule of a layer of paper or cardboard which is coated on the one side with an aluminum foil layer and on the other with a thin thermoplastic coating which is intended to form the outside coating of the package designed to protect it against outer moisture and liquid penetration. To make possible the inclusion of the aluminum foil layer an adhesive is required which as a rule is constituted of a very thin thermoplastic layer which in molten form is spread onto the paper carrier layer at the same time as the aluminum foil layer is applied and is pressed against the carrier layer with simultaneous cooling. The aluminum foil layer applied has to be protected by a plastic layer which, moreover, should constitute a sealing layer forming the inside of the finished package. Such a plastic layer is supplied by extrusion, that is to say a molten layer of thermoplastics is pressed out through a slotlike mouthpiece to form a coherent film of molten plastic which is applied to the foil layer at the same time as the molten plastic film is pressed against the foil layer by means of a cooling roller which cools and stabilizes the plastic layer. With the help of this process a good adhesion between plastic layer and aluminium foil layer is obtained. The working operations mentioned here where the different layers in the packing material are built up and combined are carried out in a machine which generally is called a laminator, and the manufacture of the material in accordance with the invention is carried out preferably in this laminator which is equipped with arrangements for grinding of the material or punches for the punching away of aluminium foil. The punching away of portions of the aluminium foil layer which is laminated to the carrier layer has to be located so that they accurately match the sealing regions within the z-folded region where the aluminium foil layer has to be removed so as to make possible a sealing with the help of induction heating. This means that the punching operation has to be guided by the impression of the crease line pattern which is arranged on the packing material so as to facilitate the forming of the package. Hence it is necessary by means of a sensing device, e.g. a photo cell or a device sensing crease lines, to register the position of the sealing panels and guide the punch for the punching out of parts of the aluminum foil layer in such a manner that the aluminum foil when it comes into contact with, and is fixed to, the carrier layer will be provided with cutouts in exactly the regions where they have to exist in order to make possible a sealing with the help of induction heating. Such sensing arrangements are known in themselves and it is possible to use any known or commercially available guiding arrangement, provided the accuracy of control is sufficient. As mentioned previously a plastic layer is placed in a final operation outside on the aluminum foil which will thus cover the aluminum foil as well as the cutout portions of the same. What was said earlier with regard to the punching out of the aluminum foil along portions which must not have any aluminum foil covering is true to the same extent for the grinding process which can also be used. In this case the carrier layer is covered with a continuous layer of aluminum foil whereupon the portions where no aluminum foil must be present are ground away with the help of a grinding process which in principle has been described earlier. This grinding process briefly consists in that the web is led over a die roll which is provided with local raised portions which are brought into contact with the parts of the packing material web where grinding is to take place and the depth of grinding is determined by the thickness of the said local raised portions or, more correctly, by how much the local raised portions project outside the nominal contour of the die roll. Adjoining the said die roll is arranged a rapidly rotating grinding roll, the distance between the grinding surface of the grinding roll and the nominal surface of the die corresponding to the thickness of the packing material, that is to say the packing material can pass between the die roll and the grinding roll without being affected by the grinding roll. However, as local raised portions are present on the die roll these will press the material against the grinding roll and the grinding roll will grind away a piece of the packing material web which corresponds to the size and surface area of the said local raised portion. The said raised portions are thus pressed against one side of the packing material while its other side is worked off with the help of the grinding roll.

In the manner which has been described the aluminum foil layer which has been applied to the packing material web can thus be ground away along the regions where no aluminum foil must be present owing to raised portions being provided on the die roll which are dimensioned so that the aluminum foil layer is ground away while the carrier material is not affected to any great extent by the grinding operation. As in the case described earlier the position of the die roll in relation to the packing material web has to be adjusted in such a manner that the grinding takes place along the correct regions and it is necessary, therefore, also in the example referred to here, for the position of the die roll in relation to the web to be adjusted with the help of a control device which senses the position of the impressed crease line pattern.

As mentioned previously, the z-folded region too has to be ground in order to obtain a thickness reduction of such an order of magnitude that the three wall panels 32 laid on top of one another within the z-folded region B correspond only to the thickness of one material layer along the regions where the sealing is to take place and the regions where the packing material is to be folded. Such a thickness reduction too can be obtained advantageously through grinding, that is to say a more extensive grinding than that which is required for the removal of the aluminum foil layer. Thus in principle ⅔rds of each material layer within the said regions 15,16,19 have to be ground away, which means that the grinding ought to be carried out preferably from the side of the packing material which is opposite the side which has the aluminum foil layer and that therefore in fact the aluminum foil layer must be maintained intact on the one sealing panel within the z-folded region. This grinding aiming at reducing thickness ought to be carried out therefore with a separate grinding unit which in principle is similar to the one described earlier. Since the depth of grinding will be greater when it is intended to reduce the thickness of the material, the local raised portions provided on the die roll must be higher and correspond to the grinding depth one wishes to achieve. In this case too the die roll has to be guided so that the ground portions 15,16,17,18,19 should be located in the right positions on the packing material. This die roll too therefore has to be guided by a control device of the type mentioned earlier. The grinding should be carried out prior to the outer plastic coating of the carrier layer, which is the layer substantially worked off by grinding, and if this is not possible a subsequent plastic coating should be applied in order that the ground portions should be covered by a plastic layer.

It is conceivable in principle for the thickness-reducing grinding of the material to be carried out only in the direction of the side of the carrier layer which is to be facing towards the inside of the package. The grinding then would have to be carried out prior to the application of the aluminum foil layer and a second grinding operation in the direction of the same side of the packing material be carried out after application of the aluminum foil layer when however only those parts would be ground away where no aluminum foil should be present so that sealing by means of induction heat can take place. The advantage of this latter procedure is that the outside of the packing material remains completely unaffected by grinding and an attractive, unaffected surface is obtained. The disadvantage is that the aluminum foil layer has to be applied to a material which is provided with "hollowings" which have been produced by means of grinding and which means that it will be more difficult to obtain a good lamination result within the said "hollowed" or ground portions. It has been found, however, that with the help of soft rubber rollers a relatively good adherence and lamination of the aluminum foil layer can be achieved even on the said ground portions and in such a case grinding in two operations in the direction of the side of the packing material, which forms the inside of the package, probably is to be preferred. Thus in the first grinding operation the thickness is reduced on the carrier material while the second grinding operation is performed only after the aluminum foil layer has been applied and this second grinding is aimed only at the removal of the aluminum foil layer along the parts where aluminum foil layer must not be present since sealing with the help of induction heat would then be rendered impossible.

In the grinding pattern may also be included the grinding of perforation lines, holes, crease lines etc. and the grinding of these can be carried out at the same time as any one of the grinding operations mentioned eariler. Thus it is possible, for example, to carry out the grinding of the whole crease line pattern in one operation and thereby obtain an automatically correct matching of e.g. the thickness-reducing regions, since the raised portions on the die roll which correspond to the crease line pattern and the thickness-reducing regions are arranged on one and the same die roll. The same applies to the opening arrangements in the form of holes, perforation lines or other weakening lines. Until now, however, the crease lines which facilitate the fold-forming of the package have been produced in such a manner that the packing material is press-formed or "crushed" as the packing material is machined between co-operating rolls, one of these rolls being provided with projecting ridges whereas the other roll has corresponding recesses, with the result that the packing material is pressed down into the said recesses and a pattern which facilitates fold-forming is produced.

With the help of the invention the technical problem is solved which arises when it is desired at the same time to obtain reinforced z-folded portions on a package with aluminum foil layer and to seal the package in a rational and rapid manner with the help of induction heat.

While the invention has been described in accordance with the preferred embodiments of the invention, it is recognized that variations and changes made be made therein without departing from the invention as set forth in the claims.

I claim:

1. A blank for packing containers comprising:

a carrier layer of paper material having inner and outer surfaces, a layer of aluminum foil, adhesive means for joining said foil layer to the inner surface of said carrier layer, said carrier layer and said foil layer having a plurality of parallel crease lines to form three adjacent panel regions capable of being folded and joined to each other in Z-shaped configuration to produce a joint having said foil layer in opposing relation to each other in two adjacent panel regions, and predetermined portions of said foil layer being removed from said carrier layer on two of said panel regions.

2. A blank as claim 1 wherein the aluminum foil layer is capable of being removed by grinding.

3. A blank as in claim 1 wherein the aluminum foil layer is capable of being removed by punching away of selected portions thereof.

4. A blank as in claim 1 wherein the remaining aluminum foil layer is located on the panel region which is situated nearest the joint to be sealed.

5. A blank as in claim 1 wherein the overlapping portions are reduced in thickness within the panel regions of the blank, the total thickness of the thickness-reduced regions when combined through folding corresponding to the normal thickness of the sheet, each of the opposite sides of the sheet being machined for thickness-reduction of the carrier layer and removal of the aluminum foil, the region for the removal of the aluminum foil layer being wholly included and embraced by the region for thickness-reduction of the carrier layer.

6. A method for the manufacture of a blank for packing containers comprising the steps of:

laminating a carrier layer of paper material and an aluminun foil layer together by an adhesive layer of extruded thermoplastic to form a laminated web;

applying a plurality of parallel crease lines to form three adjacent panel regions;

removing portions of the aluminum foil layer in two of said panel regions;

applying layers of thermoplastic material on opposite sides of said web;

folding said web along said crease lines in a Z-shaped configuration with said panel regions overlapping each other; and applying heat to seal said three adjacent panel regions together.

7. A liquid-tight packaging container comprising:

composite wall members, each formed of a carrier layer of paper material and a contiguous layer of aluminum foil covered with inner and outer continuous layers of thermoplastic materia; and joint members whereat adjoining wall members are sealingly connected, said joint members comprising said three material layers, without the presence of two of said continuous layers of aluminum foil, folded together by Z-shaped folds and heat bonded to produce liquid-tight, sealed joints.

* * * * *